US005398929A

United States Patent [19]

Kitaichi

[11] Patent Number: 5,398,929

[45] Date of Patent: Mar. 21, 1995

[54] GOLF CLUB HEAD

[75] Inventor: Hideo Kitaichi, Shizuoka, Japan

[73] Assignee: Yamaha Corporation, Shizuoka, Japan

[21] Appl. No.: 209,107

[22] Filed: Mar. 9, 1994

[30] Foreign Application Priority Data

Mar. 10, 1993 [JP] Japan ..... 5-015995

[51] Int. Cl.[6] ..... A63B 53/04

[52] U.S. Cl. ..... 273/78; 273/173

[58] Field of Search ..... 273/173, 167 J, 78, 273/77 R, 167 R, 77 A, 167 D, 193 R, 194 R, 167 F, 169, 167 H, DIG. 22, DIG. 3

[56] References Cited

U.S. PATENT DOCUMENTS

| | | | |
|---|---|---|---|
| 708,575 | 9/1902 | Mules | 273/78 |
| 1,088,571 | 2/1914 | Heffernan | 273/78 |
| 1,562,956 | 11/1925 | Guerne | 273/173 |
| 2,034,936 | 3/1936 | Barnhart | 273/78 |
| 3,043,596 | 7/1962 | Ehmke | 273/173 |
| 3,134,596 | 5/1964 | Boznos | 273/173 |
| 3,975,023 | 8/1976 | Inamori | 273/173 |
| 4,809,978 | 3/1989 | Yamaguchi | 273/173 |
| 4,884,812 | 12/1989 | Nagasaki | 273/173 |
| 5,083,778 | 1/1992 | Douglass | 273/78 |
| 5,299,807 | 4/1994 | Hutin | 273/78 |

*Primary Examiner*—Sebastiano Passaniti

*Attorney, Agent, or Firm*—Ostrolenk, Faber, Gerb & Soffen

[57] ABSTRACT

In construction of an iron-type golf club head provided with a face side shooting board, the shooting board is fitted into a recess formed in the face of a main body and an elastic intermediate is interposed between the shooting board and the recess. At shooting a ball, the shooting hoard is allowed to perform elastic displacement within the recess opposite to the direction of back-spin impartation to the ball, thereby mitigating ill influence of excessive back-spin and assuring good control on ball rolling on the field, in particular on a putting green.

4 Claims, 2 Drawing Sheets

GOLF CLUB HEAD

BACKGROUND OF THE INVENTION

The present invention relates to a golf club head, and more particularly relates to improvement in back-spin behaviour of an iron-type golf club head at shooting balls.

A conventional iron-type golf club head is generally accompanied with a substantially flat shooting board affixed to the face of its main body via bonding or screwing. Such an attachment to the face by fixation, however, tends to impart excessive back-spin to a ball shot by the club-head. In particular when a ball is shot with such an iron-type club head towards a pin hole on a putting green, the ball rolls back beyond expectation after fall on the putting green. In other words, excessive back-spin imparted to a ball at shooting allows the ball to act beyond control by a golfer.

SUMMARY OF THE INVENTION

It is thus the primary object of the present invention to restrain impartation of excess back-spin to a ball shot by an iron-type golf club head, thereby enabling easy control on ball rolling on a field.

In accordance with the basic aspect of the present invention, a recess is formed in tile face of the main body of a golf club head with an end wall extending from the bottom to the top side of the face, a shooting board is fitted into the recess with its exposed surface flush with the face on the main body, and an elastic intermediate is interposed between the recess and the shooting board.

In one preferred embodiment of the present invention, the end wall of the recess extends substantially in parallel to the face.

In another preferred embodiment of the present invention, the end wall of the recess is inclined with respect to the face so that the depth of the recess increases gradually from the bottom to the top side of the face.

DESCRIPTION OF THE PREFERRED EMBODIMENTS

Figure 1:
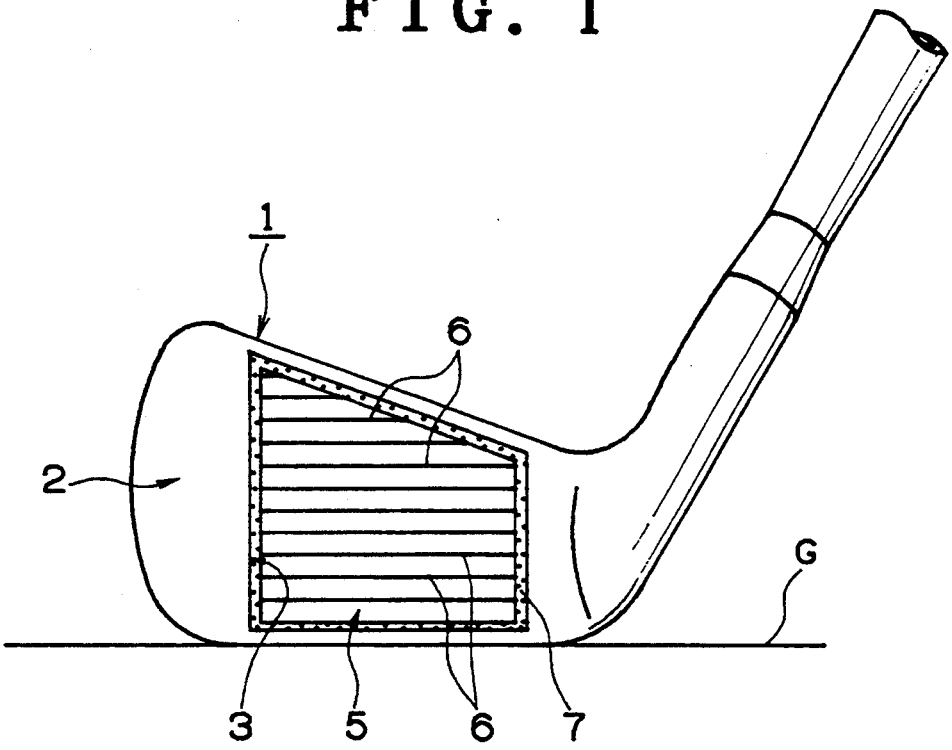
FIG. 1 is a front view of one embodiment of the golf club head in accordance with the present invention.
Figure 2:
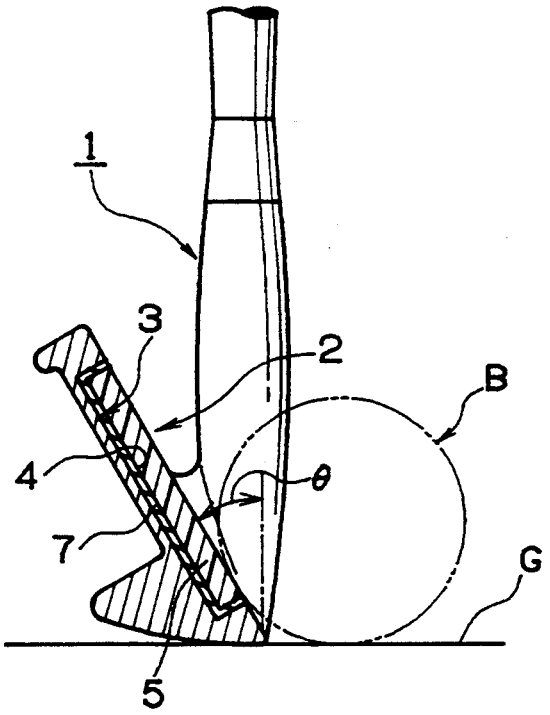
FIG. 2 is a side view, partly in section, of the golf club head shown in FIG. 1.

One embodiment of the golf club head in accordance with the present invention is shown in FIGS. 1 and 2, in which a main body 1 is provided with a recess 8 formed in its face 2 surrounding the sweet spot P. The end wall 4 of the recess 8 extends substantially in parallel to the face 2 on tile main body 1.

A shooting board 5 is fitted into the recess 3 with its exposed surface substantially flush with the face 2 on the main body 1. The shooting board 5 is made of, for example, solidified carbon fiber reinforced plastics (CFRP) and a plurality of parallel score lines 6 extends in its exposed surface in the toe-heel direction.

An elastic intermediate 7 made of, for example, rubber is interposed between the recess 3 and tile shooting board 5.

Figure 3:
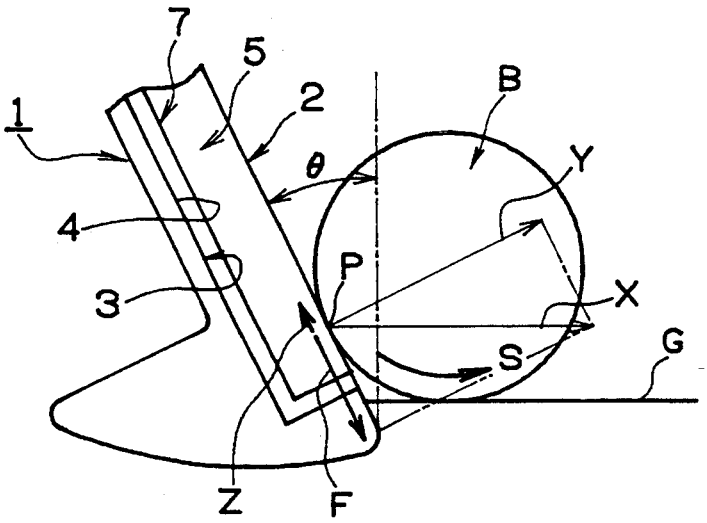
FIG. 3 is a side view for showing the kinematic behaviour of the golf club head at shooting a ball.

The behaviour of the above-described golf club head at shooting a ball B is shown in FIG. 3. When the ball B is shot at the sweet spot P in the face 2 of the main body 1, the ball B flies in a direction Y which is deviated from the shooting direction X by an angle corresponding to the loft angle $\theta$ inherent to the club head.

At this very moment of ball shooting, a friction force F at the sweet spot, which corresponds to the loft angle $\theta$, imparts back-spin to the ball B in a direction S. Thanks to the presence of the elastic intermediate 7, the shooting board displaces in a direction Z which is opposite to the direction of the friction force F and, thus, opposite to the direction of the back-spin acting on the ball B. This elastic displacement of the shooting board 5 at shooting a ball well restrains impartation of excess back-spin to the ball B.

Figure 4:
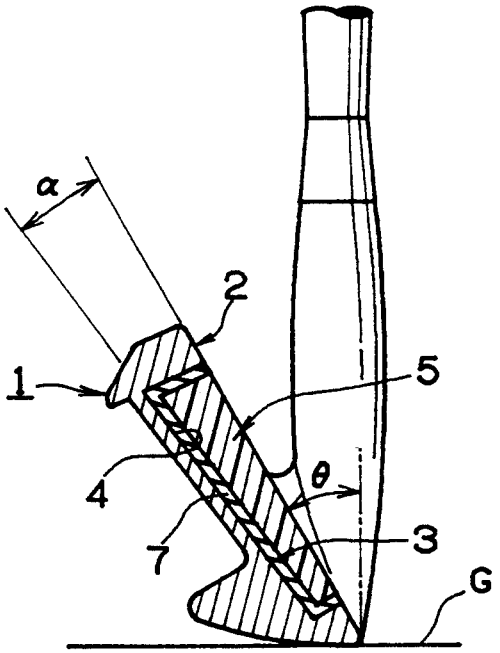
FIG. 4 is a side view, partly in section, of another embodiment of the golf club head in accordance with the present invention.

Another embodiment of the golf club head in accordance with the present invention is shown in FIG. 4, in which the depth of the recess 3 is increased gradually from the bottom to the top side of the face 2. More specifically, the end wall 4 of the recess 3 inclines with respect to the face 2 by an inclination angle $\alpha$ so that the depth of the recess 3 increases gradually in the upper section. This inclined arrangement of the end wall 4 well allows elastic displacement of the shooting board 5 even when the present invention is applied to a golf club of a loft angle near 20 degrees.

I claim:

1. A golf club head, comprising:

a main body having a face, the face including a recess having an end wall extending from a bottom to a top side, the recess having a top edge, a shooting board having a top edge and an exposed surface for striking a ball and imparting a back-spin to said ball, the shooting board being fitted into said recess with said exposed surface substantially flush with said face on said main body and with at least said top edge of said shooting board spaced from said top edge of said recess, and an elastic intermediate interposed between said top edge of said recess and said top edge of said shooting board, said elastic intermediate having sufficient elasticity so that when the shooting board strikes a ball to impart back-spin thereto, the shooting board may move toward the top edge of the recess to impart a force to the ball in a direction opposite to said back-spin.

2. A golf club head as claimed in claim 1 in which said main body is an iron-type main body.

3. A golf club head as claimed in claim 1 in which a plane containing said end wall of said recess extends substantially in parallel to a plane containing said face.

4. A golf club head as claimed in claim 1 in which said end wall of said recess is inclined with respect to said face so that the depth of said recess increases gradually from said bottom to said top side of said face.

* * * * *